United States Patent [19]

Werner

[11] Patent Number: 4,703,862

[45] Date of Patent: Nov. 3, 1987

[54] AUTOMATIC RAILROAD CAR COUPLER

[76] Inventor: George S. Werner, 6115 N. Davis Hwy., Apt. 88-A, Pensacola, Fla. 32504

[21] Appl. No.: 920,934

[22] Filed: Oct. 17, 1986

Related U.S. Application Data

[63] Continuation of Ser. No. 729,568, May 2, 1985, abandoned.

[51] Int. Cl.[4] ..... B61G 5/06

[52] U.S. Cl. ..... 213/76; 213/77

[58] Field of Search ..... 213/98, 75 R, 76, 77, 213/78

[56] References Cited

U.S. PATENT DOCUMENTS

| | | | |
|---|---|---|---|
| 490,399 | 1/1893 | Roach | 213/75 R |
| 1,056,958 | 3/1913 | Trombetti | 213/77 |
| 1,437,645 | 12/1922 | Genin | 213/76 |
| 2,052,993 | 9/1936 | Tomlinson | 213/76 |
| 2,062,740 | 12/1936 | Cartier | 213/76 |
| 2,843,056 | 7/1958 | Browne | 213/76 |
| 3,251,480 | 5/1966 | De Penti et al. | 213/76 X |

*Primary Examiner*—Robert B. Reeves
*Assistant Examiner*—Glenn B. Foster
*Attorney, Agent, or Firm*—Arthur G. Yeager

[57] ABSTRACT

An automatic air couplter for railroad cars includes a bracket (26) which supports a cylinder housing (72) underneath the coupler mechanism of a railroad car. A face plate (60) is disposed on a piston (70) which reciprocates within the cylinder housing (72). A spring (76) is maintained in compression between the face plate (60) and the cylinder housing (72) to provide an outward force. Alignment devices (62) and (64) allow for automatic alignment of the face plate (60) such that orifices (66) can mate therebetween to allow air to pass therethrough.

11 Claims, 5 Drawing Figures

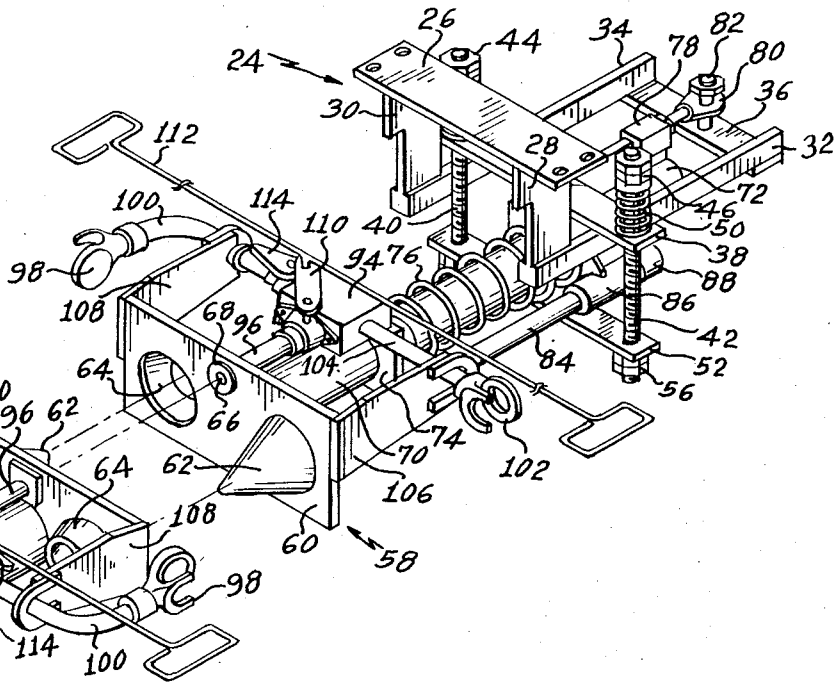
FIG. 3
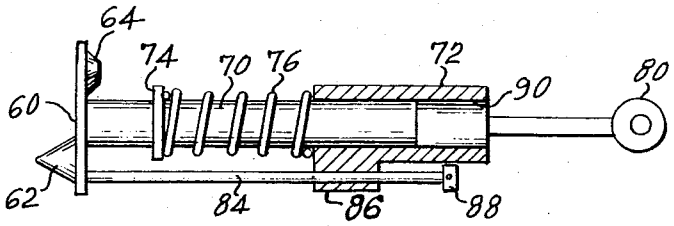
FIG. 4
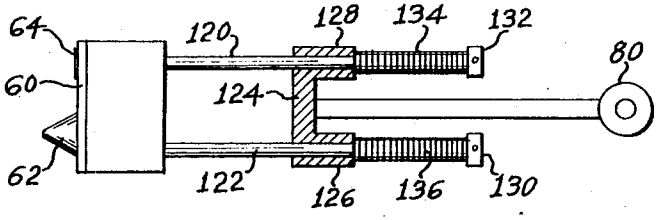
FIG. 5
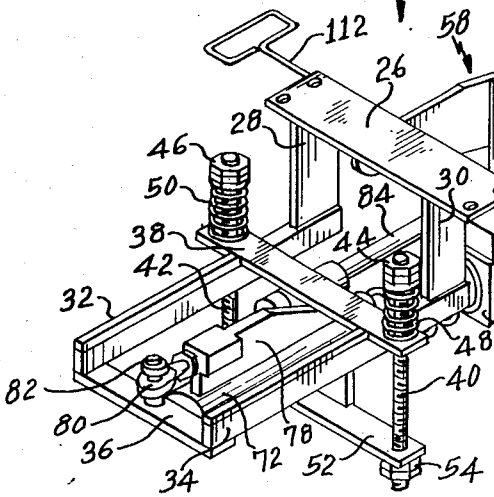

AUTOMATIC RAILROAD CAR COUPLER

This is a continuation of co-pending application Ser. No. 729,568 filed on May 2, 1985 now abandoned.

TENCHNICAL FIELD OF THE INVENTION

The present invention pertains in general to railroad cars and, more particularly, to a mechanism for coupling the railroad cars together and automatically providing a passageway for compressed air therebetween.

BACKGROUND OF THE INVENTION

In order to effectively transport railroad cars from one location to another, effective coupling of the cars together is necessitated. This coupling involves providing a mechanical linkage between the two cars in addition to electric, fluid or compressed air linkages. This mechanical linkage must allow for some vertical movement due to rough tracks in addition to a slight amount of pivot for traversing turns. These mechanical linkages are automatic such that the cars merely need to be backed up against one another to effect linkage, thus minimizing the necessity of human intervention.

The linkage of electric, fluid or pressurized air between cars is normally effected by the use of wires, hoses, etc. For example, railroad cars need a pressurized air interconnection between the two which is normally effected by hydraulic hoses which are connected by hand. However, this requires an operator to both connect the hoses and also disconnect the hoses when necessary. Therefore, the automatic nature of the coupler is somewhat detracted from since an operator is necessary to effect a complete coupling between the cars by coupling the pressure hoses.

In view of the above disadvantages, there exists a need for a railroad coupling system which effectively couples the pressurized interconnection between the two cars without requiring an operator's intervention.

SUMMARY OF THE INVENTION

The present invention disclosed and claimed herein comprises an automatic hose coupling apparatus for railroad cars. The coupling apparatus includes a stationary bracket mounted beneath the railroad car on the end thereof and disposed a predetermined distance from the roadbed. A floating housing is disposed proximate the stationary bracket and mounted to the rear end thereof on a ball joint. The ball joint allows movement in the x- and y- direction relative to the roadbed. A floating plate is disposed in a plane perpendicular to the direction of travel of the railroad car and coupled to the floating housing through a piston and cylinder arrangement. A spring is disposed between the floating housing and the floating plate to force the floating plate outward toward a coupled car. An orifice on the surface of the floating plate is connected through a valve to the hose with an O-ring around the orifice providing a seal with an identically disposed orifice on the coupled car. An alignment cone is provided on one side of the floating plate and the receptacle on the other side to align with the coupled car. The x- and y- direction are controlled by a support bracket that is supported from spring members to allow some movement in the y- direction with a sliding bracket allowing movement in the x- direction.

BRIEF DESCRIPTION OF THE DRAWINGS

For a more complete understanding of the present invention and the advantages thereof, reference is now made to the following description taken in conjunction with the accompanying Drawings in which:

FIG. 3 illustrates a detailed perspective view of the coupler;

FIG. 4 illustrates a detail of the sliding mechanism for one-half of the coupler; and FIG. 5 illustrates an alternate embodiment of the present invention.

DETAILED DESCRIPTION OF THE INVENTION

Figure 1:
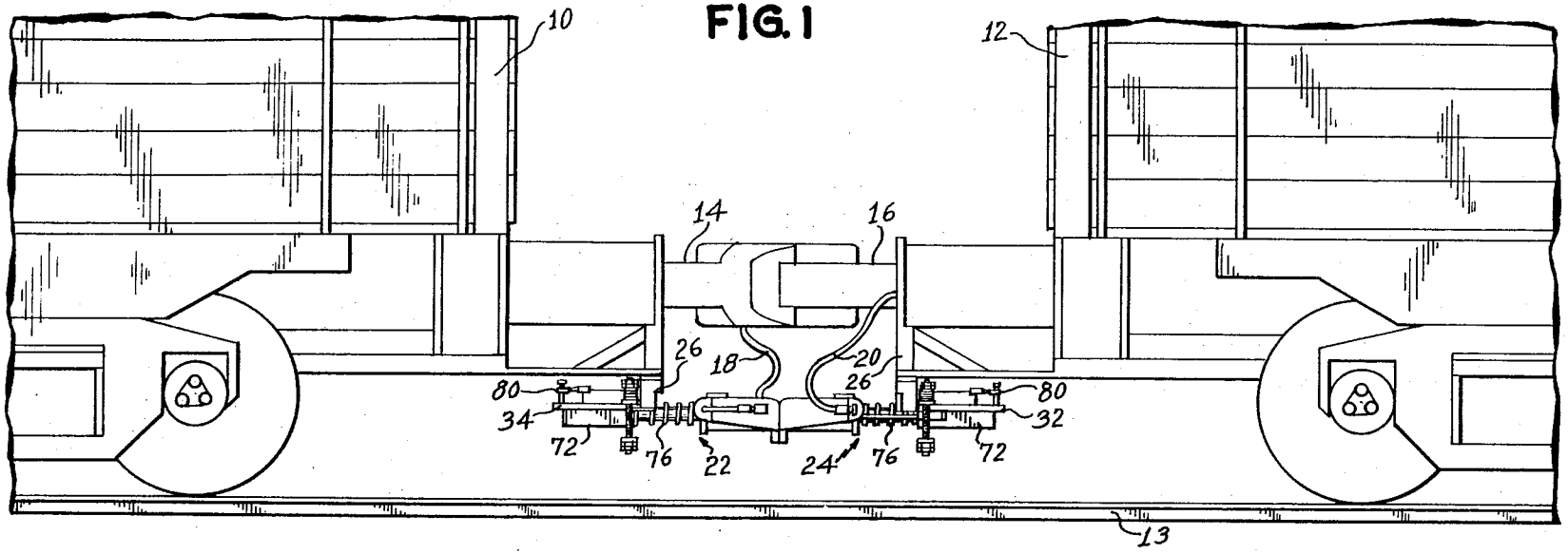
FIG. 1 illustrates a side view of the coupler system.

Referring now to FIG. 1, there is illustrated a side view of a railroad car 10 and a railroad car 12 coupled together with couplers 14 and 16, respectively. The railroad car 10 has an air hose 18, associated therewith and the railroad car 12 has an air hose 20 associated therewith. The air hose 18 is connected to a coupler 22 and air hose 20 is connected to a coupler 24. The couplers 22 and 24 cooperate to form a sealed air passageway therebetween and are automatic in operation, as will be described hereinbelow.

Figure 2:
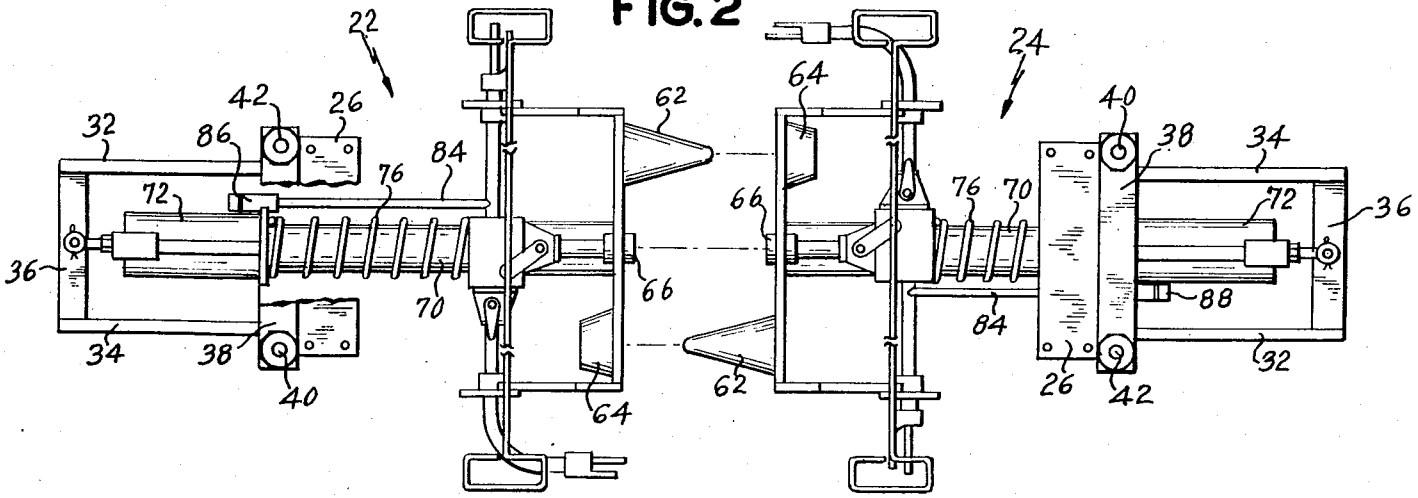
FIG. 2 illustrates a detailed top view of the coupler.

Referring further to FIG. 1 and additionally to FIGS. 2 and 3, there is illustrated top and perspective views of the couplers 22 and 24 apart from the railroad cars 10 and 12. For simplicity purposes, reference numerals on both of the air couplers 22 and 24 will be identical and only those with reference to coupler 22 will be described. The air coupler 22 is mounted onto the car 10 with a bracket 26 which has two vertical splines 28 and 30 for spacing the air coupler 22 downward from the car 10 a predetermined distance.

A first rail 32 is attached to the lower end of the vertical spline 28 and extends rearwardly therefrom horizontal to the track 13 upon which the cars 10 and 12 ride upon. Similarly, a rail 34 is attached to the lower end of the spline 30 and extends rearwardly therefrom in the same plane as the rail 32. A horizontal bracket 36 is mounted across the rearwardmost end of the rails 32 and 34 and parallel to the roadbed. A horizontal mounting bracket 38 is mounted on the upper side of the rails 32 and 34 parallel with the roadbed and extending outward therefrom on either side. There are two orifices in either end of the horizontal mounting bracket 38 for receiving two vertically hung threaded rods 40 and 42. The rods 40 and 42 have nut pairs 44 and 46, respectively, disposed on the upper end thereof. Springs 48 and 50 are disposed between the upper surface of the hanging bracket 8 and the nuts 44 and 46, respectively. A lower hanging bracket 52 is disposed below the rails 32 and 34 and has orifices in either end thereof for receiving the ends of the rods 40 and 42. Nut pairs 54 and 56 are disposed on the ends of the rods 40 and 42, respectively, to hold the lower bracket 52 thereon.

The springs 48 and 50 provide an upward and opposing force to weight that is placed on the upper surface of the support bracket 52. In addition, the nut pairs 44 and 46 are operable to change the length of the rods 40 and 42, respectively, between the upper bracket 38 and the lower bracket 52 such that the degree of height adjustment is provided relative to the bracket 52 from the roadbed.

The bracket 26 is operable to hold a floating bracket 58. The floating bracket 58 is comprised of a face plate 60 which has a plane thereof disposed perpendicular to the direction of travel for the cars 10 and 12. The face plate 60 has a male alignment device 62 disposed on one side thereof and a female receptacle 64 disposed on the other side thereof. The male alignment device 62 is cone shaped with the apex thereof disposed farthestmost from the surface of the face plate 60 and the female receptacle 64 is frustro-conical shape and has an inwardly and rearwardly tapered surface for receiving the male alignment device 62 from the opposite one of the air coupling mechanisms 22 or 24. The tapered sides of the alignment device allow for a slight misalignment until they contact the sides of the female receptacle 64, at which time either a horizontal or vertical force directly aligns the device.

A hose coupling orifice 66 is disposed between the female receptacle 64 and the mail alignment device 62 and has an O-ring 68 disposed thereabout. When the two face plates 60 are joined and properly aligned by the male alignment device 62 and the female receptacle 64, the O-rings 68 on the air couplers 22 and 24 form a pressure seal and allow air to pass through the orifices 66.

A piston rod 70 is mounted perpendicular to the rear side of face plate 60 and extends rearwardly therefrom and inserts into a cylinder housing 72 for reciprocation therein. The piston 70 has a stop 74 disposed thereabout a predetermined distance from the rear surface of the face plate 60. The forwardmost surface of the cylinder housing 72 acts as a stop also. A compression type spring 76 is disposed between the stops 74 and the surface of the cylinder housing 72 and are operable to force the face plate 60 away from the cylinder housing 72. The forwardmost edge of the cylinder housing 72 rests on the upper surface of the bracket 52 and is operable to slide in either lateral direction.

The cylinder housing 72 has a vertical spline 78 disposed along the longitudinal axis thereof and directed upward therefrom. On the uppermost and rearwardmost portion of the spline 78, a socket 80 is threadedly engaged therewith and extending rearwardly therefrom and proximate the horizontal bracket 36 which is attached to the rails 32 and 34 on the bracket 26. A cooperating ball 82 is attached to the bracket 36 and cooperates with the socket 80 to form a ball and socket joint that provides support for the cylinder housing 72. With the ball and socket joint, the front portion of the cylinder housing 72 is allowed to move vertically and horizontally with respect to the roadbed. Since the piston 70 is contrained withih the cylinder housing 72, the face plate 60 has its movement constrained thereby.

To prevent rotational movement of the face plate 60 about the longitudinal axis of the piston 70, a pilot rod 84 is attached to the rear surface of the face plate 60 and perpendicular thereto. The rod 84 extends rearwardly and parallel to the piston rod 70 and is inserted through a sleeve 86 on the side of the cylinder housing 72, the sleeve 86 being integral thereto. In addition, a stop 88 is disposed on the rearmost portion of the rod 84 to limit its forward travel through the sleeve 86. In this manner, the forward movement of the face plate 60 is also restrained. This is shown in more detail in FIG. 4, which illustrates a detailed cutaway view of the cylinder housing 72.

As illustrated in FIG. 4, the cylinder housing 72 has a bore 90 formed therein in which the piston 70 reciprocates. The depth of the bore 90 is sufficient to allow the piston full travel without either "bottoming" out or exiting the open end thereof. This exiting is prevented by the stop 88 against the rear surface of the sleeve 86. In the preferred embodiment, the spring 76 is approximately twenty-two inches long when it is uncompressed under no load. When it is fully compressed, it has a length of approximately twelve inches. Under normal load conditions with both air couplers 22 and 24 connected, normal load length is approximately fifteen inches. The length of the rod 84 is adjusted such that when the cars 10 and 12 are uncoupled, the spring forces the face plate 60 outward approximately six inches such that the spring 76 has a length of approximately eighteen inches, therefore still being under compression.

A multiple position valve 94 is interfaced with the orifice 66 through a length of conduit 96. In addition, the valve 94 is interfaced with an auxiliary connector 98 through a length of conduit 100 and also with a primary connector 102 through a length of conduit 104. The lengths of conduit 100 and 104 also function as supports and they are supported with respect to the face plate 60 through side mounting brackets 106 and 108.

The primary connector 102 is always interfaced with the valve 94 to allow air to flow therethrough. To provide air flow through the conduit 96 and the valve 94, a control 110 is provided which is a manual control that is accessible through a control arm 112 from the side of the railroad cars 10 or 12. In addition, a control 114 is provided to allow air flow from the primary connector 102 to the auxiliary connector 98. The auxiliary connector 98 is provided when a mating air coupler is not available on the adjacent railroad car. Under these conditions, the control 110 is operated to close off air flow through the conduit 96 and a control 114 is controlled to allow air flow to the auxiliary connector 98, which is connected to the air hose on the opposite vehicle.

In operation, the air couplers of the present invention are mounted on a railroad car at a predetermined height from the roadbed. This height is determined by the length of the vertical splines 28 on the brackets 26. Once the air couplers are disposed at this height, they will always mate with another. Since, as described above, the couplers extend approximately six inches outward from their normal position, the male receptacle 62 will contact the female receptacle 64 prior to an effective coupling of the cars such that a minor alignment can be made and the O-rings on mated air couplers will align such that air can pass through the complimentary orifices 68. To ensure an adequate seal, there must be approximately a five-to-one ratio of pressure to air to maintain a seal. Conventionally, the pressure is approximately 137 pounds per square inch which requires approximately 1000 pounds of force on the O-ring 68. This is provided by the compression of the spring 76.

When an effective coupling of the air couplers 22 and 24 is made, provision is provided for accommodating the various motion of the cars when traversing any type of track. For example, if there is a slight variation in height between the two cars due to an uneven roadbed, the bracket 52 and the springs 48 and 50 allow for some vertical movement. This is also facilitated by the ball and socket action of the socket 80 and ball 82. When the car is rounding a slight turn, horizontal motion is provided for by both the sliding action of the cylinder housing 72 on the lower support bracket 52 and also the socket 80 and ball 82. Of course, direction along the longitudinal axes of the pistons 70 is facilitated by the freedom of movement of the piston within the cylinder housing 72 with the spring 76 maintaining the seal between the complimentary 0-rings 68.

Referring now to FIG. 5, there is illustrated a simplied view of an alternate embodiment of the present invention, wherein like numerals refer to like parts in the various Figures. In the embodiment of FIG. 5, the piston 70 and the compression springs 76 are not utilized. As described above, the compression spring under no load conditions is approximately twenty-two inches in length and in the fully compressed state is approximately twelve inches which provides a total of ten inches of travel. To increase the travel, a bracket 124 is provided with two sleeves 126 and 128 disposed thereon. Two rods 120 and 122 are provided which are connected to the rear of the face plate 60 and perpendicular thereto. The rods 120 and 122 extend through the sleeves 126 and 128. The rod 122 has a stop 130 disposed on the rearmost end thereof and the rod 120 has a stop 132 disposed on the rearmost end thereof. A spring 134 is disposed between the sleeve 128 and the stop 132 and is fixedly attached to both the sleeve 120 and to the stop 132. In a similar manner, a spring 136 is disposed between the sleeve 126 and the stop 130 and is fixedly attached to both the sleeve 126 and to the stop 130.

In operation, when the face plate 60 reciprocates towards the car and the bracket 124, the springs 134 and 136 stretch and provide an opposing force. This is a negative compression. In the unstretched or no load condition, the spring is approximately twelve inches long. In the fully stretched position, the spring is approximately twenty-two inches long. In the normal load position, the spring is approximately eighteen inches long. Therefore, the distance between the no load condition where the springs 134 and 136 are unstretched and the fully loaded position is approximately ten inches. This is compared with the compression spring in the embodiment of FIGS. 1–4 in which the spring is always compressed to some extent and, therefore, the travel allowed is minimal.

In summary, there has been provided an automatic air coupler for railroad cars which utilizes two floating brackets mounting on the opposite cars with two O-ring seals disposed on opposing faces of the bracket. Alignment devices are provided on the brackets to allow precise alignment of the O-rings such that a passageway disposed therethrough can communicate air between the two cars. The floating brackets are operable to provide a compressive force against each other and also to provide movement in the x, y and z directions to provide movement in conjunction with the railroad cars traversing over uneven ground and around curves.

Although the present embodiment has been described in detail, it should be understood that various changes, substitutions and alterations can be made therein without departing from the spirit and scope of the invention as defined by the appended claims.

What is claimed is:

1. An automatic hose coupling apparatus for railroad cars comprising:

a rigid housing affixed to the railroad car including two spaced rails parallel to the direction of travel of the railroad car to provide support for said coupling at a predetermined distance above the roadbed, a lateral bracket joined to each of said rails and a cylinder attached adjacent one end thereof to said bracket by a ball-and-socket connection;

floating means movably supported on said rails including a face plate having a contact face lying in a plane perpendicular to the direction of travel of the railroad car with said contact face being vertically and horizontally movable to a limited extent within said plane, a piston affixed to said face plate and reciprocally engaged with said cylinder to permit limited movement of said face plate perpendicular to said plane, and spring means connected to said cylinder and said piston biased to urge said face plate to a preselected fully extended distance away from said housing, an upper lateral support member above said rails and a lower lateral support member below said rails with said support members being fastened to each other by two vertical rods fastened respectively to the ends of said support members laterally outside said rails, said rods being spring biased to urge said support members towards each other;

said face plate including spaced male and female conical coupling means adapted to mate with a second identical face plate when the two face plates are positioned face-to-face; and resilient sealing and coupling means projecting outwardly from said face with a central passageway through said sealing and coupling means and the face plate adapted to be connected to a source of a compressed fluid to form a pressure seal when pressed against an identical sealing and coupling means on a second face plate.

2. The apparatus of claim 1 wherein said cylinder is constrained in its vertical movement between said upper lateral support member and said lower lateral support member.

3. The apparatus of claim 1 wherein said male coupling means is a conical projection protruding outwardly from said face, and said female coupling means is a conical recess extending rearwardly from said face.

4. The apparatus of claim 1 which additionally comprises a pilot rod connected at one end thereof to said face plate and longitudinally slideably connected to said cylinder at the other end thereof, said pilot rod being spaced apart from and parallel to said piston rod.

5. The apparatus of claim 1 wherein said resilient sealing and coupling means includes an elastomeric O-ring.

6. The apparatus of claim 1 wherein the passageway in said coupling means is connected to a valve to control the flow of compressed fluid therethrough.

7. The apparatus of claim 6 wherein said valve has an operative outlet to a standard compressed air connector, and said valve has a manually operated control to operatively connect said air connector to said source of compressed fluid.

8. An automatic compressed air hose coupling apparatus for railroad cars comprising:

a rigid rectangular housing adapted to be affixed to a railroad car adjacent one end thereof with portions of said housing depending below said car to support a pair of spaced parallel horizontal rails connected at their rearmost ends by a lateral bracket lying in a plane generally parallel to and at a preselected distance above the plane of the roadbed and a ball-and-socket connecting means affixed to said lateral bracket medially between said rails;

a coupling plate generally perpendicular to the direction of travel of the railroad car and supported by said housing in a manner to provide limited lateral movement in two directions and limited longitudinal movement, said coupling plate including a conical projection therefrom and spaced apart from said projection a conical recess, the conical shapes of the projection and recess being mutually similar to permit mating connection when two such plates are contacted face-to-face, said coupling plate also including an annular resilient projection surrounding an opening in said plate communicating with a passageway through said plate and adapted to be connected to a source of compressed air, said annular projection being capable of forming a pressure seal when pressed against an identical annular projection of a second face plate;

a hollow cylinder having a forward end and a rearward end, said rearward end being pivotally attached to said ball-and-socket connection;

a pair of spaced horizontal bars laterally positioned, respectively, above and below said rails and joined to each other by vertical spring loaded rods biased to urge said horizontal bars toward each other, said hollow cylinder slideably supporting on the lower of said bars between said rails;

a piston affixed to said coupling plate and slideably engaged with said cylinder; and a coil spring around said piston biased to urge said coupling plate away from said cylinder.

9. The apparatus of claim 8 wherein said vertical rods are threaded and said horizontal bars are connected thereto by nut means to provide vertical adjustment of said bars.

10. The apparatus of claim 8 wherein said annular projections are compressible O-ring seals.

11. The apparatus of claim 8 which includes a pilot rod connected to said coupling plate and longitudinally slideably connected to said cylinder and adapted to prevent rotation of said piston in said cylinder.

* * * * *